US010686299B2

(12) United States Patent
Imanaka et al.

(10) Patent No.: US 10,686,299 B2
(45) Date of Patent: Jun. 16, 2020

(54) SPARK PLUG OF INTERNAL COMBUSTION ENGINE

(71) Applicant: DENSO CORPORATION, Kariya, Aichi-pref. (JP)

(72) Inventors: Yasuomi Imanaka, Kariya (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/509,911

(22) Filed: Jul. 12, 2019

(65) Prior Publication Data

US 2020/0036164 A1 Jan. 30, 2020

(30) Foreign Application Priority Data

Jul. 24, 2018 (JP) ..... 2018-138305

(51) Int. Cl.
*H01T 13/04* (2006.01)
*H01T 13/08* (2006.01)
*H01T 13/20* (2006.01)

(52) U.S. Cl.
CPC ..... *H01T 13/04* (2013.01); *H01T 13/08* (2013.01); *H01T 13/20* (2013.01)

(58) Field of Classification Search
CPC ..... H01T 13/04; H01T 13/08; H01T 13/20; H01T 13/02; H01T 13/34; H01T 13/36
See application file for complete search history.

(56) References Cited

U.S. PATENT DOCUMENTS

2016/0218485 A1* 7/2016 Nakamura ..... H01T 13/20

FOREIGN PATENT DOCUMENTS

JP 2015-115302 6/2015

* cited by examiner

*Primary Examiner* — Anne M Hines
(74) *Attorney, Agent, or Firm* — Nixon & Vanderhye P.C.

(57) ABSTRACT

A spark plug has a spark plug housing of a cylindrical shape, an insulator of a cylindrical shape, a central electrode, a ground electrode and a terminal metal fitting. The insulator has a head part projecting toward a distal end side of the spark plug from the spark plug housing. The central electrode and the ground electrode forms a discharge gap. The terminal metal fitting, electrically connected to the central electrode, has a main body part and an exposed part. The exposed part of the terminal metal fitting has a head part. An outer diameter of the head part of the exposed part is greater than an outer diameter of the main body part. A ratio Dt/Di of not less than 0.8 is satisfied, Di represents an outer diameter of the head part of the insulator and Dt represents an outer diameter of the head part of the exposed part.

4 Claims, 6 Drawing Sheets

SPARK PLUG OF INTERNAL COMBUSTION ENGINE

CROSS-REFERENCE TO RELATED APPLICATION

This application is related to and claims priority from Japanese Patent Application No. 2018-138305 filed on Jul. 24, 2018, the contents of which are hereby incorporated by reference.

TECHNICAL FIELD

The present disclosure relates to spark plugs of internal combustion engines.

BACKGROUND

There have been used spark plugs as a member for igniting a fuel mixture gas in an internal combustion engine mounted on motor vehicles. A spark plug has a spark plug housing, an insulator, a central electrode, a ground electrode, and a terminal metal fitting. The spark plug housing has a male screw part. The male screw part is formed on an outer peripheral surface of the spark plug housing and fitted with a female part formed in a cylinder head of an internal combustion engine. The spark plug housing has a cylindrical shape.

The insulator has a cylindrical shape and is supported by the inside of the spark plug housing. The insulator has a head part projecting from the spark plug housing side toward a distal end part of the spark plug.

The central electrode is arranged at and supported by a front end part of the insulator. The ground electrode is arranged at a front end part of the spark plug housing so that a discharge gap is formed between the central electrode and the ground electrode. The terminal metal fitting is inserted into the inside of the insulator from the distal end side of the insulator. The terminal metal fitting has a main body part and a head part. The main body part of the terminal metal fitting is arranged at the inside of the insulator. The head part of the terminal metal fitting is exposed from the insulator side to the distal end side of the spark plug. The head part of the terminal metal fitting has a diameter which is greater than that of the main body part. The spark plug is electrically connected to an ignition coil through the terminal metal fitting. The ignition coil generates a high voltage and supplies it to the spark plug through the terminal metal fitting.

SUMMARY

It is desired for the present disclosure to provide a spark plug of an internal combustion engine. The spark plug has a spark plug housing of a cylindrical shape, an insulator of a cylindrical shape, a central electrode, a ground electrode and a terminal metal fitting. The terminal metal fitting has a main body part and an exposed part. The main body part is arranged at an inside of the insulator. The exposed part projects toward a distal end side of the spark plug from a head part of the insulator. The exposed part has a head part. An outer diameter of the head part of the exposed part is greater than an outer diameter of the main body part. The spark plug satisfies a ratio Dt/Di of not less than 0.8 (i.e. Dt/Di≥0.8), where Di represents an outer diameter of the head part of the insulator and Dt represents an outer diameter of the head part of the exposed part of the terminal metal fitting.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
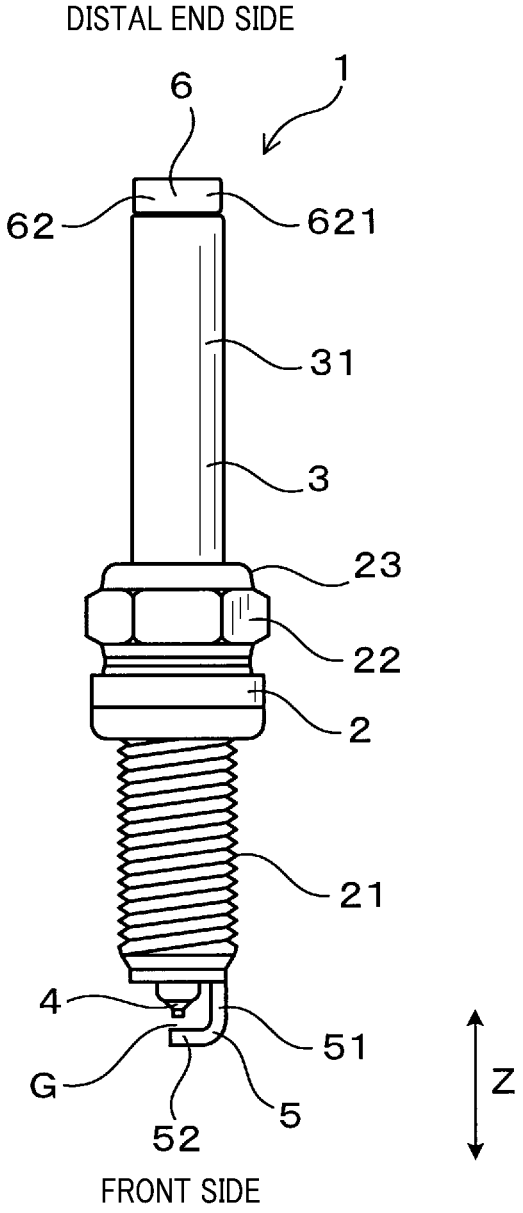
FIG. 1 is a plan view of a spark plug according to a first exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

First Exemplary Embodiment

A description will be given of the spark plug 1 according to a first exemplary embodiment with reference to FIG. 1 to FIG. 3.

FIG. 1 is a plan view of the spark plug 1 according to the first exemplary embodiment of the present disclosure. As shown in FIG. 1, the spark plug 1 according to the first exemplary embodiment has a spark plug housing 2, an insulator 3, a central electrode 4, a ground electrode 5 and a terminal metal fitting 6. The spark plug housing 2 has a cylindrical shape. The insulator 3 is supported by the inside of the spark plug housing 2. The insulator 3 also has a cylindrical shape. The insulator 3 has a head part 31 which is projects to the distal end side of the spark plug 1 from the spark plug housing 2. The central electrode 4 is supported by the inside of the insulator 4. The central electrode 4 and the ground electrode 5 form a discharge gap G. That is, the discharge gap G is formed between the central electrode 4 and the ground electrode 5.

Figure 2:
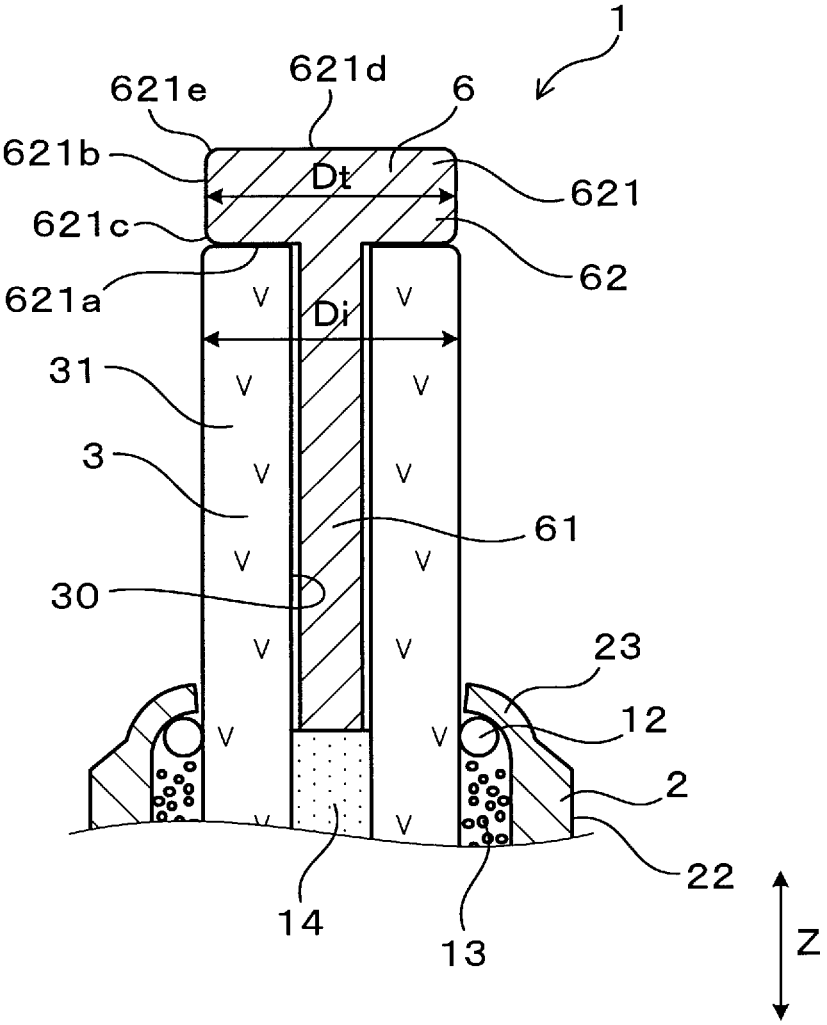
FIG. 2 is a view showing a cross section of the spark plug shown in FIG. 1, which runs taken along a central axis of the spark plug and is perpendicular to a plug axial direction of the spark plug.

FIG. 2 is a view showing a cross section of the spark plug 1 shown in FIG. 1, which runs taken along a central axis of the spark plug 1 and is perpendicular to a plug axial direction Z of the spark plug 1.

As shown in FIG. 2, the terminal metal fitting 6 has a main body part 61 and an exposed part 62. The exposed part 62 of the terminal metal fitting 6 is arranged at the distal end side of the spark plug 1 and exposed to the outside of the spark plug 1. The main body part 61 of the terminal metal fitting 6 is arranged at the interior of the insulator 3. The exposed part 62 of the terminal metal fitting 6 projects toward the distal end side of the spark plug 1 from a head part 31 of the insulator 3. The terminal metal fitting 6 is electrically connected to the central electrode 4.

As shown in FIG. 2, the exposed part 62 of the terminal metal fitting 6 has a head part 621. The head part 621 has an outer diameter which is greater than that of the main body part 61.

As shown in FIG. 2, the spark plug 1 according to the first exemplary embodiment, the head part 621 of the exposed part 62 of the terminal metal fitting 6 has an outer diameter which is greater than an outer diameter of the main body part 61 of the terminal metal fitting 6. The spark plug 1 according to the first exemplary embodiment satisfies a ratio Dt/Di of not less than 0.8 (i.e. $Dt/Di \geq 0.8$), where Di represents the outer diameter of the head part 31 of the insulator 3, and Dt represents the outer diameter of the head part 621 of the exposed part 62 of the terminal metal fitting 6.

A description will be given of the spark plug 1 according to the first exemplary embodiment in more detail. In the following explanation, the plug axial direction Z shown in FIG. 2 extends through a central axis of the spark plug 1.

For example, the spark plug 1 is applied as an ignition device to internal combustion engines of automobiles, co-generation systems, etc. In the plug axial direction Z, one terminal of the spark plug 1, i.e. the distal end side of the spark plug 1 is electrically connected to an ignition coil (not shown), and the other terminal of the spark plug 1, i.e. the front end side of the spark plug 1 is arranged in the inside of the combustion chamber of an internal combustion engine.

As shown in FIG. 1, a screw part 21 is formed in the spark plug housing 2. The screw part 21 of the spark plug housing 2 is screwed into a female screw part formed in an engine head (not shown) of the internal combustion engine.

As shown in FIG. 1, the spark plug housing 2 has a tool mating part 22 which is formed at the distal end side of the screw part 21. An outline of the tool mating part 22 has a hexagonal shape viewed along the plug axial direction Z of the spark plug 1.

In order to fit the spark plug 1 into the engine head of the internal combustion engine, the outer periphery of the screw part 21 is mated with a hex wrench, and the spark plug 1 is screwed into the female screw part of the engine head by using the hex wrench. In order to correctly fit the hex wrench to the tool mating part 22, the hex wrench is inserted from the exposed part 62 of the terminal metal fitting 6.

As shown in FIG. 1 and FIG. 2, the spark plug housing 2 has a caulked part 23 formed at the distal end side of the tool mating part 22. The caulked part 23 has been caulked toward the front end side of the spark plug 1. As shown in FIG. 2, the caulked part 23 presses the insulator 3 toward the front end side of the spark plug 1 through a pair of ring members 12 and a powder filler member 13. FIG. 2 shows one of the ring members 12 only. The ring members 12 and the powder filler member 13 are arranged in a gap firmed between the insulator 3 and the spark plug housing 2. In particular, the ring members 12 are arranged at two different locations along the plug axial direction Z of the spark plug 1. A gap between the pair of ring members 12 is filled with the powder filler member 13. This allows the gap between the insulator 3 and the spark plug housing 2 to have superior airtight capability. The ring member 12 at the upper side is only shown in FIG. 2.

As shown in FIG. 1, the front end side of the insulator 3 projects from the spark plug housing 2. The head part 31 of the insulator 3 projects from the distal end side of the spark plug housing 2. As shown in FIG. 2, the insulator 3 has an axial hole part 30 which penetrate the inside of the insulator 3 along the plug axial direction Z of the spark plug 1. The central electrode 4 and the terminal metal fitting 6 are arranged in the inside of the axial hole part 30.

As shown in FIG. 1 and FIG. 2, the head part 31 of the insulator 3 has approximately a constant diameter viewed in the plug axial direction Z of the spark plug 1. A corner part of the insulator 3, which connects the distal end surface of the insulator 3 with the outer peripheral surface of the head part 31 has a round shape or a taper shape toward the distal end side of the insulator 3. A plug gap of the ignition coil (not shown) is assembled with the outer peripheral surface of the head part 31 of the insulator 3.

The plug gap is made of resin and has a cylindrical shape. The plug gap of the ignition coil (not shown) is inserted from the distal end side of the spark plug 1 so as to be fitted with the spark plug 1.

As shown in FIG. 2, the terminal metal fitting 6 is inserted into the axial hole part 30 of the insulator 3 and supported by the inside of the insulator 3. As previously described, the terminal metal fitting 6 has the main body part 61 and the exposed part 62. The main body part 61 of the terminal metal fitting 6 is arranged in the inside of the insulator 3. The exposed part 62 projects from the head part 31 of the insulator 3 toward the distal end side of the spark plug 1. The main body part 61 has a longitudinal and cylindrical shape along the plug axial direction Z of the spark plug 1.

As shown in FIG. 2, the exposed part 62 has an outer diameter which is greater than an outer diameter of the main body part 61 of the terminal metal fitting 6. In the terminal metal fitting 6 in the spark plug 1 according to the first exemplary embodiment, the overall exposed part 62 is substantially equal to the head part 621.

The head part 621 of the exposed part 62 has a cylindrical shape having an outer diameter which is greater than that of the main body part 61 of the terminal metal fitting 6. As shown in FIG. 2, a corner part 621*c* has a rounded shape. A front end surface 621*a* of the head part 621 is connected to an outer peripheral surface 621*b* of the head part 621 by the corner part 621*c*. Similarly, a corner part 621*e* has a rounded shape. A distal end surface 621*d* of the head part 621 is connected to the outer peripheral surface 621*b* of the head part 621 by the corner part 621*e*.

As shown in FIG. 2, the front end surface 621*a* of the head part 621 is in contact with the distal end surface of the head part 31 of the insulator 3. That is, a gap is formed in the plug axial direction Z between the head part 621 of the exposed part 62 and the head part 31 of the insulator 3.

The spark plug 1 according to the first exemplary embodiment satisfies a ratio Dt/Di of not less than 0.8, i.e. $Dt/Di \geq 0.8$. As shown in FIG. 2, Di represents an outer diameter of the head part 31 of the insulator 3, and Dt represents an outer diameter of the head part 621 of the exposed part 62 of the terminal metal fitting 6. In other words, Di represents the maximum outer diameter of the head part 31 of the insulator 3. For example, when a corrugation part is formed on the head part 31 of the insulator 3, the outer diameter of the head part 31 of the insulator 3 varies in the plug axial direction Z. In this case, Di represents the maximum outer diameter of the head part 31 of the insulator 3.

The outer diameter Dt of the head part 621 of the exposed part 62 indicates the maximum outer diameter of the head part 621. That is, when the outer diameter of the head part 621 varies, Di represents the maximum outer diameter of the head part 621 of the exposed part 62 of the terminal metal fitting 6.

The structure of the spark plug 1 according to the first exemplary embodiment further satisfies the ratio Dt/Di of not less than 0.9.

Further, the spark plug 1 according to the first exemplary embodiment satisfies the ratio Dt/Di of not less than 0.8 and not more than 1 (i.e. 1≥Dt/Di≥0.8). Stiff further, the spark plug 1 according to the first exemplary embodiment satisfies the ratio Dt/Di of not less than 0.9 (i.e. 1≥Dt/Di≥0.9). The diameter (or, the maximum outer diameter) of the head part 621 of the exposed part 62 of the terminal metal fitting 6 is not more than the diameter (or, the maximum outer diameter) of the head part 31 of the insulator 3.

Figure 3:
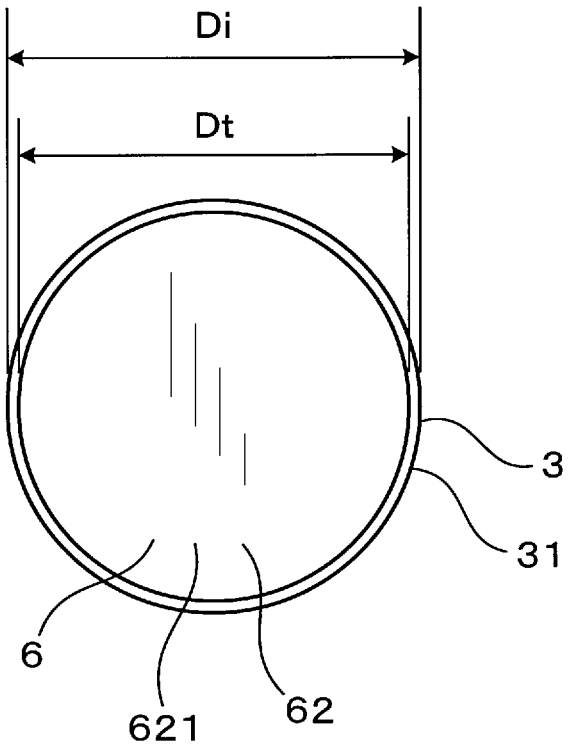
FIG. 3 is a plan view of a head part of an exposed part of a terminal metal fitting and a head part of an insulator in the spark plug shown in FIG. 1 when viewed from a distal end side of the spark plug along the plug axial direction of the spark plug.

FIG. 3 is a plan view of the head part 621 of the exposed part 62 of the terminal metal fitting 6 and the head part 31 of the insulator 3 in the spark plug 1 shown in FIG. 1 when viewed from the distal end side of the spark plug 1 along the plug axial direction Z of the spark plug 1.

As shown in FIG. 3, the head part 621 of the exposed part 62 is arranged within the inside of the outer diameter of the head part 31 of the insulator 2, viewed from the distal end side of the spark plug 1 along the plug axial direction Z of the spark plug 1.

As shown in FIG. 1, the outer diameter of the head part 621 of the exposed part 62 of the terminal metal fitting 6 is not more than the outer diameter of the tool mating part 22. It is possible for the tool mating part 22 to have the diameter within a range of 14 mm to 16 mm.

As shown in FIG. 2, the central electrode 4 is arranged through a glass sealing 14 made of copper glass, etc. at the front end side of the terminal metal fitting 6. As shown in FIG. 1, the front end side of the central electrode 4 projects from the insulator 3.

As shown in FIG. 1, the ground electrode 5 is arranged facing the front end surface of the central electrode 4 in the plug axial direction Z of the spark plug 1. That is, the discharge gap G is formed in the plug axial direction Z between the front end surface of the central electrode 4 and the ground electrode 5.

The ground electrode 5 has a rod-shaped part 51 (or a projection) and an opposing part 52. The rod-shaped part 51 extends from the front end part of the spark plug housing 2 in the plug axial direction Z of the spark plug 1. The opposing part 52 faces the central electrode 2 in the plug axial direction Z, and has a curved shape which is curved from the rod-shaped part 51 inwardly in a radius direction of the spark plug 1. The opposing part 52 faces the central electrode 2.

A description will now be given of behavior and effects of the spark plug 1 according to the first exemplary embodiment.

The spark plug 1 according to the first exemplary embodiment satisfies the ratio Dt/Di of not less than 0.8 (i.e. Dt/Di≥0.8). That is, the outer diameter Dt of the head part 621 of the exposed part 62 of the terminal metal fitting 6 is greater than the outer diameter Di of the head part 31 of the insulator 3. This structure of the spark plug 1 satisfying the ration Dt/Di of not less than 0.8 makes it possible to effectively reduce electric flux passing through the distal end part of the head part 31 of the insulator 3. It is thereby possible to suppress corona discharge from being generated on the surface of the head part 31 of the insulator 3. That is, this structure of the spark plug 1 makes it possible to suppress generation of flashover. The ratio Dt/Di of not less than 0.8 (Dt/Di≥0.8) can be clearly supported by the experimental data which will be explained later.

A description will be given of the electric flux f generated between the terminal metal fitting 6 and the spark plug housing 2 with reference to FIG. 4.

Figure 4:
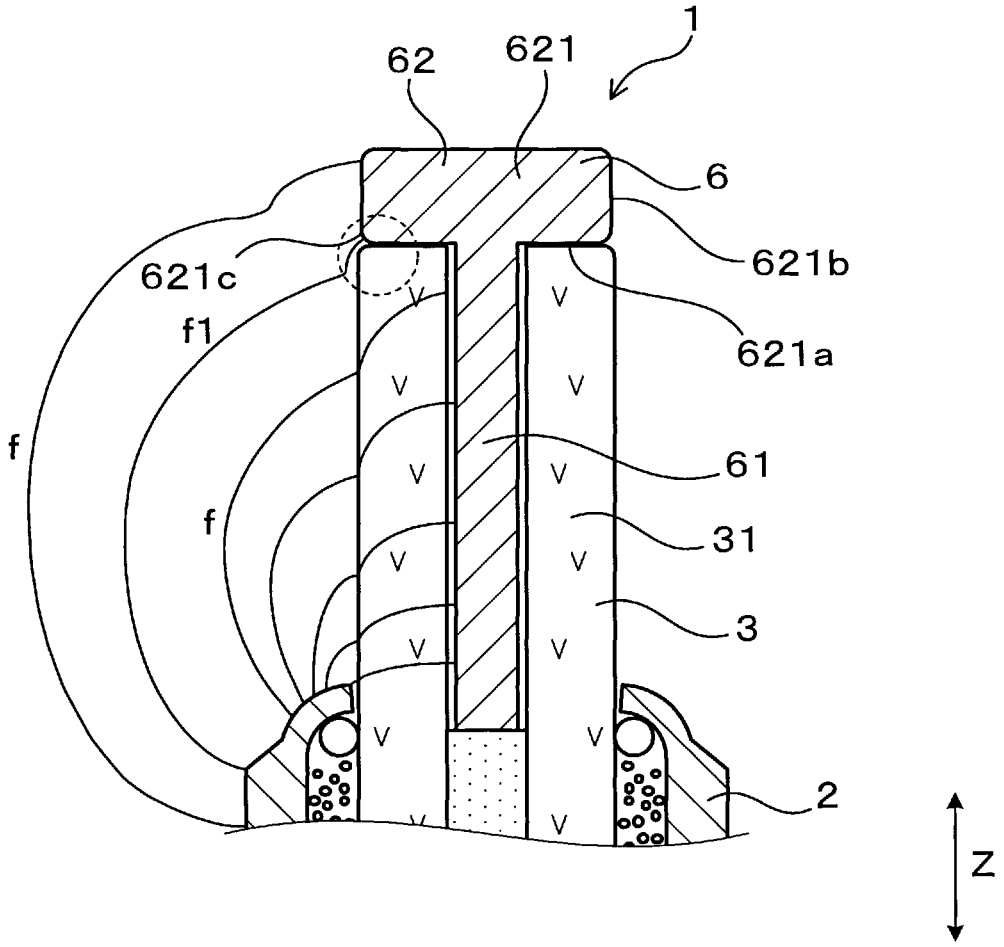
FIG. 4 is a view schematically showing a phenomenon of generating electric flux in the spark plug shown in FIG. 1 which satisfies a ratio Dt/Di of not less than 0.8 (Dt/Di≥0.8)

FIG. 4 is a view schematically showing a phenomenon of generating electric flux fin the spark plug 1 shown in FIG. 1.

First electric flux f1 as a part of the electric flux f is generated between the terminal metal fitting 6 and the spark plug housing 2. As shown in FIG. 4, this first electric flux f1 is generated between the corner part 621*c* and the spark plug housing 2. The corner part 621*c* connects the front end surface 621*a* of the head part 621 of the exposed part 62 with the outer peripheral surface 621*b* of the head part 621 of the exposed part 62. That is, the first electric flux f1 is generated in air atmosphere, i.e. does not pass through the distal end part of, designated by the dotted circle shown in FIG. 4, the head part 31 of the insulator 3.

Figure 5:
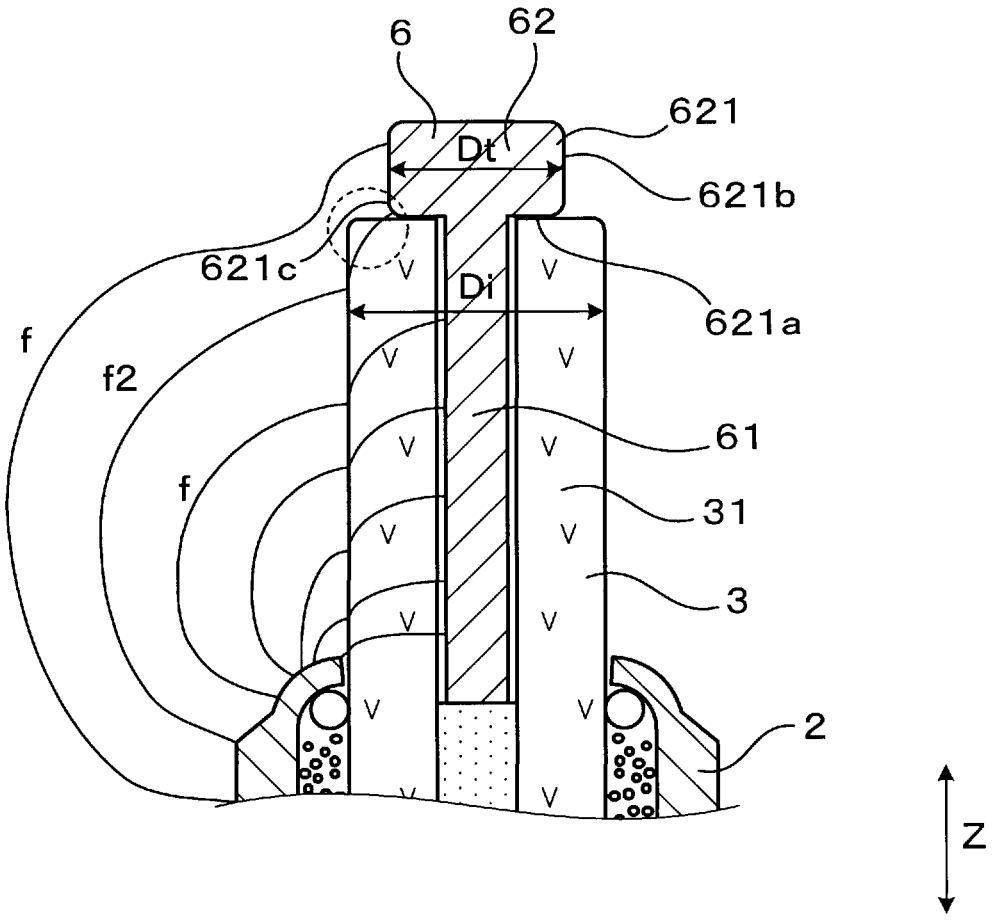
FIG. 5 is a view schematically showing a phenomenon of generating electric flux in a spark plug as a comparative example which satisfies the ratio Dt/Di of less than 0.8 (Dt/Di<0.8)

FIG. 5 is a view schematically showing a phenomenon of generating electric flux in a spark plug according to a comparative example. That is, FIG. 5 shows a phenomenon of generating electric flux in the spark plug as a comparative example which satisfies the ratio Dt/Di of less than 0.8 (Dt/Di<0.8).

When the spark plug has the ratio Dt/Di of less than 0.8 shown in FIG. 5, second electric flux f2 as a part of the electric flux f is generated between the terminal metal fitting 6 and the spark plug housing 2. As shown in FIG. 5, this second electric flux f2 is generated between the corner part 621*c* and the spark plug housing 2. As previously described, the corner part 621*c* connects the front end surface 621*a* of the head part 621 of the exposed part 62 with the outer peripheral surface 621*b* of the head part 621 of the exposed part 62. That is, the second electric flux f2 passes through the distal end part of, designated by the dotted circle shown in FIG. 5, the head part 31 of the insulator 3. In particular, as shown in FIG. 5, high-density electric flux is generated in the surrounding of the corner part 621*c*. This increases an amount of, or a density of electric flux passing through the distal end part of the head part 31 of the insulator 3.

As previously explained, it is preferable for the spark plug 1 according to the first exemplary embodiment to have a structure which satisfies the ratio Dt/Di of not less than 0.8 (Dt/Di≥0.8). When the ratio Dt/Di is not less than 0.8 (Dt/Di≥0.8) shown in FIG. 4, it is possible to reduce an amount of, or a density of electric flux passing though the distal end part of the head part 31 of the insulator 3 as compared with the case shown in FIG. 5 which satisfies the ratio Dt/Di of less than 0.8 (Dt/Di<0.8).

Accordingly, it can be understood for the spark plug 1 according to the first exemplary embodiment to suppress generation of corona discharge on the surface of the distal end part of the head part 31 of the insulator 3. This structure makes it possible to suppress generation of flashover in the spark plug 1.

It is further preferable for the spark plug 1 according to the first exemplary embodiment to have a structure which satisfies the ratio Dt/Di of not less than 0.9 (Dt/Di≥0.9). This structure makes it further possible to reduce generation of flashover in the spark plug 1. This structure of the spark plug 1 makes it even more able to suppress generation of flashover. The ratio Dt/Di of not less than 0.9 (Dt/Di≥0.9) can also be clearly supported by the experimental data which will be explained later.

Still further, the spark plug 1 according to the first exemplary embodiment has the structure which satisfies the ratio Dt/Di of not more than 1 (i.e. Dt/Di≤1). In other words, the spark plug 1 according to the first exemplary embodiment satisfies the ratio Dt/Di within a range of not less than 0.8 and not more than 1 (i.e. 0.8≤Dt/Di≤1). In addition, the spark plug 1 according to the first exemplary embodiment also satisfies the ratio Dt/Di within a range of not less than 0.9 and not more than 1 (i.e. 0.9≤Dt/Di≤1).

In the structure of the spark plug 1 according to the first exemplary embodiment, the outer diameter (or the maximum outer diameter) of the head part 621 of the exposed part 62 of the terminal metal fitting 6 is not more than the outer diameter (or the maximum outer diameter) of the head part 31 of the insulator 3.

This structure of the spark plug 1 makes it possible to suppress reduction of electric insulation between the inside and the outside of a plug cap when the spark plug 1 is fitted to the plug cap of the ignition coil (not shown).

That is, a gap is formed between the head part 31 of the insulator 3 and the plug cap of the ignition coil (not shown) because the pug cap is pressed toward the head part 621 of the exposed part 62 side when the spark plug satisfies the ratio Dt/Di of more than 1 (Dt/Di>1) and the head part 621 of the exposed part 62 of the terminal metal fitting 6 projects outward toward the outer peripheral side of the spark plug as compared with the head part 31 of the insulator 3, and the head part 31 of the insulator 3 is fitted to the plug cap of the ignition coil (not shown). This case reduces electric insulation between the inside and outside of the plug cap as long as the plug cap and the head part 31 of the insulator 3 are sealed together, for example, as far as the inner diameter of the plug cap is adjusted.

On the other hand, the spark plug 1 according to the first exemplary embodiment satisfying the ratio of not more than 1 (i.e. Dt/Di≤1), the head part 621 of the exposed part 62 is located in the inside of the outer diameter of the head part 31 of the insulator 3 when viewed from the axial direction Z of the spark plug 1. This makes it possible to prevent reduction of electric insulation between the inside and outside of the plug cap without adjusting the shape of the inner peripheral surface of the plug cap.

Further, the outer diameter (i.e. the maximum outer diameter) of the head part 621 of the exposed part 62 of the terminal metal fitting 6 is not more than the diameter of the tool mating part 22. This makes it possible to avoid unnecessary influence of the hex wrench to the head part 621 of the exposed part 62 when the tool mating part 22 is mated with the hex wrench so as to screw the spark plug 1 into the female screw hole of the engine head so as to fix the spark plug 1 to the engine head of an internal combustion engine (not shown). This prevents reduction of workability when the spark plug 1 is mated with the engine head of the internal combustion engine.

As previously described in detail, the spark plug 1 according to the first exemplary embodiment can be applied to various types of internal combustion engines. The spark plug 1 according to the first exemplary embodiment has the improved structure of suppressing generation of flashover.

First Experiment

A description will be given of the first experiment. The first experiment used test samples 1 to 11 substantially having the same basic structure of the spark plug 1 according to the first exemplary embodiment. The test samples 1 to 10 have the head part 621 of the exposed part 62 of the terminal metal fitting 6 having a different outer diameter Dt, and the head part 31 of the insulator 3 having a different outer diameter Di. That is, the test samples have a different ratio Dt/Di. The first experiment detected a withstand voltage between the terminal metal fitting 6 and the spark plug housing 2 in each of the test samples.

Table 1 shows the outer diameter Dt (mm), the outer diameter Di (mm), the ratio Dt/Di, and an evaluation result of each of the test samples 1 to 10. The test samples substantially have the same basic structure of the spark plug 1 according to the first exemplary embodiment. As shown in Table 1, the test samples 1 to 10 have a different value of the outer diameter Dt (mm), a different value of the outer diameter Di (mm), and a different value of the ratio Dt/Di.

In particular, as shown in Table 1, each of the test samples 1 to 4 has the head part 31 of the insulator 3 having the outer diameter Di of 10.5 mm, and each of the test samples 5 to 10 has the head part 31 of the insulator 3 having the outer diameter Di of 9 mm. For example, a commercially available spark plug has the head part 31 of the insulator 3 having the outer diameter Di of 10.5 mm or 9 mm. Each of the test samples 1 to 10 has the head part 621 of the exposed part 62 of the terminal metal fitting 6 having a length of 3.3 mm measured in the axial direction Z.

A description will now be given of an experimental method. A front end part including the discharge gap G of each test sample was dipped in an insulation oil so as to generate no discharge in the discharge gap G. Under this situation, a voltage was applied between the terminal metal fitting 6 and the spark plug housing 2 in each test sample. While boosting the supplied voltage at a rate of 1 (kV/10 sec.), the first experiment detected a flashover voltage when flashover was generated between the terminal metal fitting 6 and the spark plug housing 2 in each test sample.

A description will now be given of an evaluation method of evaluating performance of each of the test samples 1 to 10.

As shown in Table 1, in the test samples 1 to 4 having the head part 31 of the insulator 3 which has the outer diameter Di of 10.5 mm, the test sample 1 has the minimum ratio Dt/Di which is less than 0.8. Accordingly, the first experiment performs evaluation using the test sample 1 as a reference sample.

The evaluation regarding the withstand voltage of each test sample is performed on the basis of a withstand voltage difference ΔV (kV) obtained by subtracting the flashover voltage (kV) of each of the test samples 2 to 4 from the flashover voltage (kV) of the reference sample (the test sample 1).

Specifically, the evaluation result D is provided to a test sample of ΔV≤0. On the other hand, the evaluation result C is provided to a test sample of 0<ΔV<1. The evaluation result B is provided to a test sample of 1≤ΔV<2. The evaluation result A is provided to a test sample of 2≤ΔV.

The evaluation results are designated by using reference characters A, B, C and D in an order starting from a highest withstand voltage.

As shown in Table 1, in the test samples 5 to 10 having the head part 31 of the insulator 3 which has the outer diameter Di of 9 mm, the test sample 5 has the minimum ratio Dt/Di which is less than 0.8. Accordingly, the evaluation will use the test sample 5 as a reference sample.

The evaluation regarding the withstand voltage is performed on the basis of a difference value ΔV (kV) obtained by subtracting the flashover voltage (kV) of each of the test samples 6 to 10 from the flashover voltage (kV) of the reference sample (the test sample 5).

Specifically, the evaluation result D is provided to a test sample of ΔV≤0. On the other hand, the evaluation result C is provided to a test sample of $0<\Delta V<1$. The evaluation result B is provided to a test sample of $1\leq\Delta V<2$. The evaluation result A is provided to a test sample of $2\leq\Delta V$.

The evaluation results are designated by using reference characters A, B, C and D in an order starting from a highest withstand voltage.

Table 1 shows the evaluation results of the test samples 1 to 10.

TABLE 1

| Test samples | Dt[mm] | Di[mm] | Dt/Di | Evaluation results |
|---|---|---|---|---|
| 1 | 6.4 | 10.5 | 0.61 | — |
| 2 | 8.5 | 10.5 | 0.81 | B |
| 3 | 10.5 | 10.5 | 1 | A |
| 4 | 12 | 10.5 | 1.14 | A |
| 5 | 6.4 | 9 | 0.71 | — |
| 6 | 7.2 | 9 | 0.8 | C |
| 7 | 7.5 | 9 | 0.83 | B |
| 8 | 8.5 | 9 | 0.94 | B |
| 9 | 10.5 | 9 | 1.17 | A |
| 10 | 12 | 9 | 1.33 | A |

It can be understood from Table 1 that the test samples 2 to 4 and the test samples 6 to 10 having the ratio Dt/Di of not less than 0.8 ($Dt/Di\geq0.8$) have the evaluation result of not less than C (i.e. one of A, B and C), and have the withstand voltage which is higher than the withstand voltage of the reference samples (test sample 1 and test sample 5) having the ratio Dt/Di of less than 0.8 ($Dt/Di<0.8$).

Further, the test samples 3, 4 and 8 to 10 having the ratio Dt/Di of not less than 0.9 ($Dt/Di\geq0.9$) have the evaluation result of not less than B (i.e. A or B), and have a higher withstand voltage.

Still further, the test samples 3, 4, 9 and 10 having the ratio Dt/Di of not less than 1 ($Dt/Di\geq1$) have the evaluation result A, and have the highest withstand voltage.

Second Exemplary Embodiment

A description will be given of the spark plug 1 according to a second exemplary embodiment with reference to FIG. 6.

Figure 6:
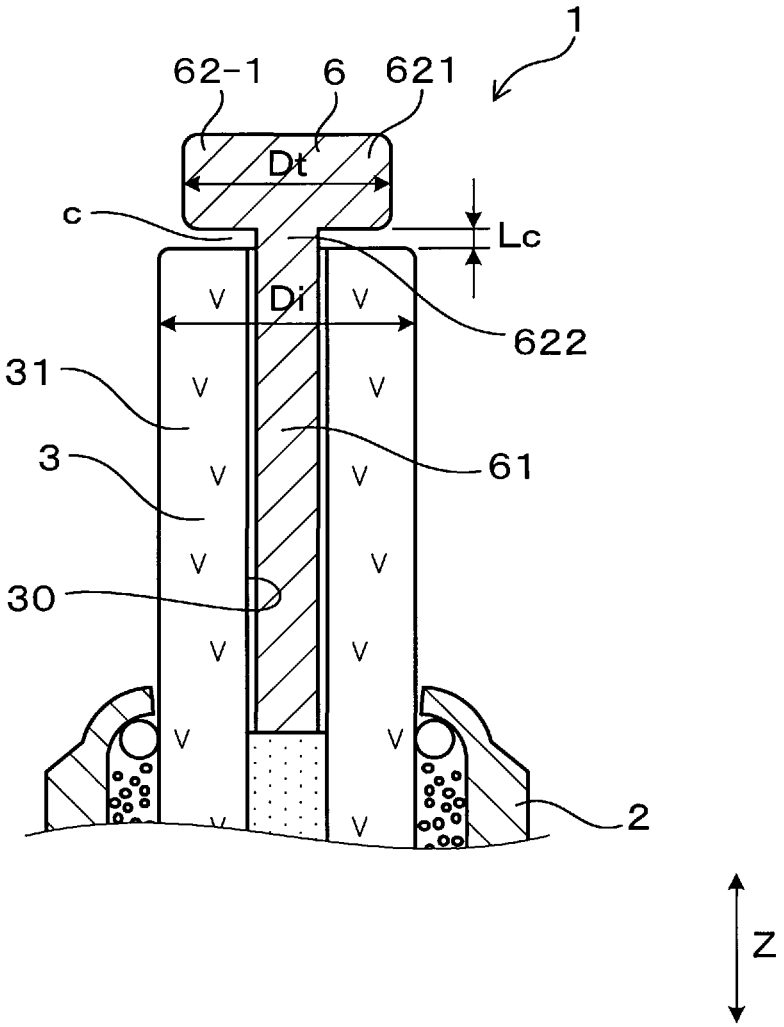
FIG. 6 is a view showing a cross section of the spark plug according to a second exemplary embodiment of the present disclosure, which runs taken along a central axis of the spark plug and is perpendicular to a plug axial direction of the spark plug.

FIG. 6 is a view showing a cross section of the spark plug 1 according to the second exemplary embodiment of the present disclosure, which runs taken along a central axis of the spark plug and is perpendicular to the plug axial direction of the spark plug.

As shown in FIG. 6, the spark plug 1 according to the second exemplary embodiment has an exposed part 62-1 of the terminal metal fitting 6. The exposed part 62-1 is different in shape from the exposed part 62 (see FIG. 1) of the terminal metal fitting 6 in the spark plug according to the first exemplary embodiment.

The spark plug 1 according to the second exemplary embodiment has the structure in which a gap c is formed between the head part 31 of the insulator 3 and the exposed part 62-1 of the terminal metal fitting 6. The exposed part 62-1 of the terminal metal fitting 6 is composed of a front end part 622 and the head part 621. As shown in FIG. 6, the front end part 622 is arranged at the front end side of the exposed part 62-1 in the axial direction Z of the spark plug 1. On the other hand, the head part 621 is arranged at the distal end side of the terminal metal fitting 6. In particular, the spark plug according to the second exemplary embodiment has the gap c formed between the exposed part 62-1 of the terminal metal fitting 6 and the head part 31 of the insulator 3 in the axial direction Z of the spark plug 1.

When the gap c previously described is designated by a reference character Lc, the spark plug according to the second exemplary embodiment satisfies a relationship of $Lc\geq0.1$ mm. That is, the gap Lc, viewed in the axial direction Z, formed between the head part 31 of the insulator 3 and the exposed part 62-1 of the terminal metal fitting 6 is not less than 0.1 mm. Further, the spark plug 1 according to the second exemplary embodiment satisfies a relationship of $Lc\geq0.3$ mm, i.e. satisfies the relationship of $0.3\text{ mm}\geq Lc\geq0.1$ mm. In addition, similar to the first exemplary embodiment, the spark plug 1 according to the second exemplary embodiment satisfied the ratio Dt/Di of not less than 0.8 (i.e. $Dt/Di\geq0.8$).

Other components in the spark plug 1 according to the second exemplary embodiment are the same of those in the spark plug according to the first exemplary embodiment. The same components between the second exemplary embodiment and the first exemplary embodiment are designated by the same reference numbers and characters. The explanation of the same components is omitted here for brevity.

Because the spark plug 1 according to the second exemplary embodiment satisfies the relationship of $Lc\leq0.1$ mm, this structure makes it possible to separate the head part 621 of the exposed part 62-1 of the terminal metal fitting 6 from the head part 31 of the insulator 3. This makes it possible to further suppress the electric flux generated between the head part 621 of the exposed part 62-1 of the terminal metal fitting 6 from passing through the inside of the head part 31 of the insulator 3. This makes it possible to further suppress generation of corona discharge on the distal end surface of the head part 31 of the insulator 3, and to avoid generation of flashover in the spark plug 1.

Still further, the spark plug according to the second exemplary embodiment satisfies the relationship of $Lc\geq0.3$ mm (i.e. $0.3\text{ mm}\geq Lc\geq0.1$ mm). This structure makes it possible to apply, to the insulator 3, a stress caused by the vibration of the terminal metal fitting 6 due to vibration generated in the spark plug 1.

On the other hand, when the spark plug satisfies the relationship of $Lc>0.3$ mm, the head part 621 of the exposed part 62-1 of the terminal metal fitting 6 easily vibrates due to the increased gap Lc, and as a result a large stress is applied from the terminal metal fitting 6 to the insulator 3. The spark plug according to the second exemplary embodiment have the same behavior and effects of the spark plug according to the first exemplary embodiment.

Second Experiment

A description will be given of the second experiment. The second experiment used test samples 11 to 15 substantially having the same basic structure of the spark plug according to the second exemplary embodiment. The second experiment used the reference sample having Lc of 0 mm (Lc=0 mm), as the test sample 2 previously explained in the first exemplary embodiment. The test samples 11 to 15 have a different Lc. The second experiment detected a withstand voltage between the terminal metal fitting 6 and the spark plug housing 2 in each of the test samples 11 to 15.

As shown in Table 2, the test sample 2 as the reference sample has Lc=0 mm. The test samples 11 to 15 have Lc=0.1 mm, 0.2 mm, 0.3 mm, 0.5 mm, and 1 mm, respectively. Each of the reference sample, 2 and the test samples 11 to 15 has Dt=8.5 mm, Di=10.5 mm, the ratio Dt/Di=0.81. The test sample 2 as the reference sample corresponds to the test sample 2 explained in the first exemplary embodiment. The second experiment used the same method of detecting a withstand voltage of each of the test samples.

The second experiment used the same evaluation method of evaluating performance of each of the test samples 11 to 15 on the basis of the performance of the reference sample as the test sample 2.

The evaluation regarding the withstand voltage is performed on the basis of a withstand voltage difference ΔV obtained by subtracting the flashover voltage of each of the test samples 6 to 10 from the flashover voltage of the reference sample (the test sample 2).

Specifically, the evaluation result D is provided to a test sample of $\Delta V \leq 0$. On the other hand, the evaluation result C is provided to a test sample of $0 < \Delta V < 1$. The evaluation result B is provided to a test sample of $1 \leq \Delta V < 2$. The evaluation result A is provided to a test sample of $2 \leq \Delta V$. The evaluation results are designated by using reference characters A, B, C and D in an order starting from a highest withstand voltage.

Table 2 shows the evaluation results of the test samples 1 to 15.

TABLE 2

| Test samples | Dt[mm] | Di[mm] | Lc[mm] | Dt/Di | Evaluation results |
|---|---|---|---|---|---|
| 2 | 8.5 | 10.5 | 0 | 0.81 | — |
| 11 | 8.5 | 10.5 | 0.1 | 0.81 | B |
| 12 | 8.5 | 10.5 | 0.2 | 0.81 | A |
| 13 | 8.5 | 10.5 | 0.3 | 0.81 | A |
| 14 | 8.5 | 10.5 | 0.5 | 0.81 | A |
| 15 | 8.5 | 10.5 | 1 | 0.81 | A |

It can be understood from the experimental results shown in Table 2 that the test samples 11 to 15 have a high withstand voltage which is higher than the withstand voltage of the reference sample (as the test sample 2). The test samples 11 to 15 having the gap Lc of not less than 0.1 ($Lc \geq 0.1$) have the evaluation result of not less than B (i.e. A or B).

Further, it can be understood from the experimental results shown in Table 2 that the test samples 12 to 15 having the gap Lc of not less than 0.2 mm ($Lc \geq 0.2$ mm) have the evaluation result A.

Incidentally, there often happens a possible case in which when a spark plug is exposed to a high voltage environment, an insulation breakdown, i.e. flashover is often generated between the spark plug housing and the head part of the terminal metal fitting thereof. No spark discharge is generated in a discharge gap formed between the central electrode and the ground electrode of the spark plug due to generation of flashover. This prevents smooth ignition of a fuel mixture gas fed into a combustion chamber of an internal combustion engine.

A related art has provided a spark plug having a structure in which the spark plug housing is composed of a metal part and an insulation part made of resin so as to avoid the generation of flashover. That is, a distal end part of the spark plug housing is made of resin so as to maintain a distance between the metal part of the spark plug housing to the terminal metal fitting. However, in the structure of the spark plug according to the related art previously described, the head part of the terminal metal fitting, which is exposed to the distal end side of the insulator, the terminal metal fitting is less in outer diameter than a head part of the insulator. This structure allows an electric flux generated between the head part of the terminal metal fitting and the spark plug housing to easily run on a surface of the distal end side of the head part of the terminal metal fitting. Accordingly, this increases an electrical gradient on the surface of a distal end part of the insulator. That is, the structure of the spark plug according to the related art allows easy generation of a corona discharge on the surface of the distal end part of the insulator. The corona discharge often causes flashover phenomenon. It is accordingly necessary to improve the structure of the spark plug according to the related art so as to avoid the generation of flashover.

On the other hand, the present disclosure provides the spark plug having the improved structure previously described. In particular, the spark plug according to the present disclosure satisfies the ratio Dt/Di of not less than 0.8. This structure represents that the head part of the exposed part of the terminal metal fitting is formed to have the outer diameter Dt which is greater than the outer diameter Dt of the head part of the insulator. This improved structure makes it possible to reduce electric flux, which passes through the distal end side of the head part of the insulator, and to suppress generation of a corona discharge on a surface of the head part of the insulator. This makes it possible to reduce generation of flashover in the spark plug. The ratio Dt/Di of not less than 0.8 has been supported by experimental results which will be explained in detail later.

As previously described, the present disclosure provides the spark plug having the improved structure which suppresses generation of flashover. The spark plug can be applied to various devices such as internal combustion engines.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug for an internal combustion engine, comprising:

a spark plug housing having a cylindrical shape;

an insulator having a cylindrical shape supported by an inside of the spark plug housing, the insulator comprising a head part projecting toward a distal end side of the spark plug from the spark plug housing;

a central electrode supported by an inside of the insulator;

a ground electrode arranged facing the central electrode to form a discharge gap; and a terminal metal fitting electrically connected to the central electrode, the terminal metal fitting comprising a main body part and an exposed part, the main body part being arranged at the inside of the insulator and the exposed part projecting toward the distal end side of the spark plug from the head part of the insulator, the exposed part of the terminal metal fitting comprising a head part, an outer diameter of the head part of the exposed part of the terminal metal fitting being greater than an outer diameter of the main body part of the terminal metal fitting, wherein a ratio Dt/Di is not less than 0.9 ($Dt/Di \geq 0.9$), where Di represents an outer diameter of the head part of the insulator, and Dt represents an outer diameter of the head part of the exposed part of the terminal metal fitting.

2. The spark plug for an internal combustion engine according to claim 1, wherein the ratio Dt/Di is not more than 1 ($Dt/Di \leq 1$).

3. A spark plug for an internal combustion engine, comprising:

a spark plug housing of a cylindrical shape;

an insulator of a cylindrical shape supported by an inside of the spark plug housing, the insulator comprising a head part projecting toward a distal end side of the spark plug from the spark plug housing;

a central electrode supported by an inside of the insulator;

a ground electrode arranged facing the central electrode to form a discharge gap; and a terminal metal fitting electrically connected to the central electrode, the terminal metal fitting comprising a main body part and an exposed part, the main body part being arranged at the inside of the insulator and the exposed part projecting toward the distal end side of the spark plug from the head part of the insulator, the exposed part of the terminal metal fitting comprising a head part, an outer diameter of the head part of the exposed part of the terminal metal fitting being greater than an outer diameter of the main body part of the terminal metal fitting, wherein a gap Lc is formed in a plug axial direction Z between the head part of the insulator and a front end part of the exposed part of the terminal metal fitting, and the gap Lc is not less than 0.1 mm ($Lc \geq 0.1$ mm).

4. The spark plug for an internal combustion engine according to claim 3, wherein, the gap (Lc) satisfies a relationship of 0.3 mm$\geq Lc \geq$0.1 mm.

* * * * *